US008776914B2

(12) United States Patent
Demichel et al.

(10) Patent No.: US 8,776,914 B2
(45) Date of Patent: Jul. 15, 2014

(54) DRAINAGE METHOD FOR MULTILAYER RESERVOIRS

(75) Inventors: Cindy Demichel, Sévres (FR); Charles Woodburn, Paris (FR); Gokhan Saygi, Neuilly sur Seine (FR); Yves Manin, Le Plessis Robinson (FR); Ashok Belani, Paris (FR); Mohamed Watfa, Dubail (AE)

(73) Assignee: Schlumberger Technology Corporation, Sugar Land, TX (US)

( * ) Notice: Subject to any disclaimer, the term of this patent is extended or adjusted under 35 U.S.C. 154(b) by 617 days.

(21) Appl. No.: 12/670,937

(22) PCT Filed: Jul. 1, 2008

(86) PCT No.: PCT/EP2008/005446

§ 371 (c)(1),
(2), (4) Date: Jun. 7, 2010

(87) PCT Pub. No.: WO2009/018883

PCT Pub. Date: Feb. 12, 2009

(65) Prior Publication Data

US 2010/0282518 A1 Nov. 11, 2010

(30) Foreign Application Priority Data

Aug. 6, 2007 (EP) ..... 07113883

(51) Int. Cl.
*E21B 7/04* (2006.01)

(52) U.S. Cl.
USPC ..... 175/62; 166/50

(58) Field of Classification Search
USPC ..... 166/50; 175/62
See application file for complete search history.

(56) References Cited

U.S. PATENT DOCUMENTS

| | | | | |
|---|---|---|---|---|
| 2,107,007 | A * | 2/1938 | Lang | 166/269 |
| 4,519,463 | A | 5/1985 | Schuh | |
| 4,522,260 | A * | 6/1985 | Wolcott, Jr. | 166/245 |
| 4,533,182 | A | 8/1985 | Richards | |
| 4,803,873 | A * | 2/1989 | Ehlig-Economides | 73/152.31 |
| 6,344,746 | B1 * | 2/2002 | Chunduru et al. | 324/339 |
| 7,224,162 | B2 * | 5/2007 | Proett et al. | 324/303 |
| 7,980,312 | B1 * | 7/2011 | Hill et al. | 166/303 |
| 2004/0050552 | A1 | 3/2004 | Zupanick | |
| 2007/0039729 | A1 | 2/2007 | Watson | |

FOREIGN PATENT DOCUMENTS

| | | |
|---|---|---|
| WO | WO03050377 | 6/2003 |
| WO | WO2004007906 | 1/2004 |

OTHER PUBLICATIONS

XP002467152, Schlumberger Oilfield Glossary, drainage.
XP002467151, Schlumberger Oilfield Glossary, drainage area.

(Continued)

*Primary Examiner* — David Andrews
*Assistant Examiner* — Robert E Fuller
(74) *Attorney, Agent, or Firm* — Stephanie Chi; Jody DeStefanis

(57) ABSTRACT

A main borehole is drilled into an underground reservoir comprising a plurality of layers of different fluid mobilities. The fluid mobility in each of the plurality of layers is determined. A number of lateral boreholes extending from the main borehole in each of the plurality of layers are then drilled based on the determined fluid mobility in each of the plurality of layers, such that resulting fluid production rates in each of the plurality of layers are substantially similar.

7 Claims, 3 Drawing Sheets

(56) References Cited

OTHER PUBLICATIONS

M. Karakas et al, "Semianalytical Productivity Models for Perforated Completions," Society of Petroleum Engineers, 1990, SPE 21477 (Supplemental to SPE18247).

Eclipse Technical Description 2006.2 pp. 1061-1083.

K. Furui, et al, "A New Skin Factor Model for Perforated Horizontal Wells," Sep. 2008, SPE Drilling & Completion, pp. 205-215, SPE77363.

* cited by examiner

DRAINAGE METHOD FOR MULTILAYER RESERVOIRS

TECHNICAL FIELD

This invention relates to a method of enhancing the production of hydrocarbons from multilayer reservoirs, and in particular is directed to methods for determining a proper arrangement of lateral boreholes to provide an improved drainage surface for reservoirs having layers of different properties.

BACKGROUND ART

In oil and gas wells not all the oil and gas in a reservoir can be recovered. This problem is particularly severe in multilayer reservoirs. Using traditional production methods oil and gas may be bypassed due to the cross flows or water coning that occurs as the layers in the reservoirs are depleted.

Production of oil and gas from a reservoir is dependant on the mobility of the fluid in the reservoir. Mobility is effectively the ease with which fluids can be produced from a formation and depends on characteristics such as porosity, permeability and fluid viscosity. In multilayer reservoirs, for a given fluid viscosity, the more permeable layers will typically have a higher production rate and will be depleted much faster than the less permeable layers in the reservoir. If one layer is depleted faster than the other layers, this can lead to the build up of greater pressure differences between the layers than are initially present. These pressure differences can cause cross-flows between the layers and the greater pressure gradient formed during production can cause water coning and water breakthrough in the wellbore. To prevent cross-flow and early water breakthrough the production parameters from the various layers have to be closely controlled.

In a conventional well completion, a single borehole is drilled through the layers of the reservoir. The borehole is usually lined with a steel casing surrounded by cement which prevents fluid communication between the layers. Communication between the layers and the interior of the casing is permitted by forming perforations in the casing and cement. The number and arrangement of perforations in a layer will determine the degree of communication possible between the layer and the borehole.

In certain circumstances, no casing is used (barefoot completion) but such completions can be problematic due to the lack of support for the formation and the possibility of borehole collapse, sanding and the like. Ultimately, the ability of the borehole to produce fluids is limited by the surface area of the borehole in the layer in question.

It has been proposed to complete a borehole and manage production from the different layers to reduce the pressure differences between the various layers and so minimise the problems indicated above. However, this can often lead to an overall reduction in the rate of production from the borehole.

In order to improve drainage from a reservoir, it has been proposed to drill lateral boreholes or drain holes, which extend from the main borehole into the producing reservoir layer. While such an approach does allow a greater producing surface to be obtained in a given reservoir layer, the problems of pressure differences between layers still occur.

Therefore it is an object of the invention to provide a method which allows construction of lateral boreholes which can flatten the pressure profile of multilayer reservoirs to enhance the recovery of hydrocarbons.

DISCLOSURE OF THE INVENTION

A first aspect of the invention provides a method of determining the arrangement of lateral boreholes to be drilled from a main borehole that traverses an underground reservoir comprising at least two layers of different fluid mobility, the method comprising:

- determining formation parameters in each layer of interest so as to determine the fluid mobility in each layer; and
- determining borehole parameters for a series of lateral boreholes in each layer, the number, arrangement and dimensions of the lateral boreholes being selected such that the drainage surface in each layer provides for substantially similar fluid drainage in each layer irrespective of the fluid mobility in that layer.

The formation parameters typically include permeability, porosity and well inclination. The borehole parameters typically include radius of the lateral, the angle of deviation of the lateral from the main borehole, the length of the lateral borehole, and the thickness of the layer.

The series of lateral boreholes are preferably selected to minimise pressure differences between the layers of the reservoir.

The method may also include the use of parameters relating to completion of the lateral boreholes which modify the drainage of fluid into the lateral borehole.

In certain cases, there may be no lateral boreholes to be drilled from the main borehole in one or more layers.

The arrangement of the lateral boreholes can include the axial arrangement along the length of the main borehole in the layer and azimuthal arrangement around the circumference of the main borehole in the layer. The arrangement may also include the track of each lateral borehole away from the main borehole. The track may be non-linear.

The dimensions can include the diameter and length of the lateral borehole.

Parameters relating to the construction of the lateral boreholes can be derived from parameters of drilling equipment available to drill the lateral boreholes.

Another aspect of the invention comprises a method of constructing a well comprising drilling a main borehole that traverses an underground reservoir comprising at least two layers of different fluid mobility, determining an arrangement of lateral boreholes to be drilled from a main borehole in accordance with the invention defined above and drilling the lateral boreholes in accordance with the determined arrangement.

The invention provides a method for enhancing hydrocarbon recovery from a multilayer reservoir by drilling into the reservoir layers with lower mobilities to increase the drainage surface area of the layer such that the all layer have substantially the same production rate.

Increasing the drainage surface area of the reservoir layer having the lower flow rate, will increase the flow rate of the low flow rate layer, and applying this approach to the various layers flattens the pressure profile of the multilayer reservoir. This can help improve the productivity of the well.

The drainage surface area of the low flow rate reservoir layer can be increased by a variety of ways including:

- drilling lateral boreholes (drainholes) into the reservoir layer having the lowest initial flow rate;
- drilling lateral drainholes into the reservoir layer having the lowest initial flow rate that are longer than the length of the drainholes drilled in the higher flow rate reservoir layer;
- drilling drainholes at a deviated angle into the reservoir layer having the lowest initial flow rate and drilling lateral drainholes in the higher flow rate reservoir layer; and drilling lateral drainholes into the reservoir layer having the lowest initial flow rate that have a larger diameter than the diameter of the drainholes in the high flow rate reservoir layer.

Any combination of one or more of the above may be used to increase the drainage surface area.

MODE(S) FOR CARRYING OUT THE INVENTION

Figure 1A:
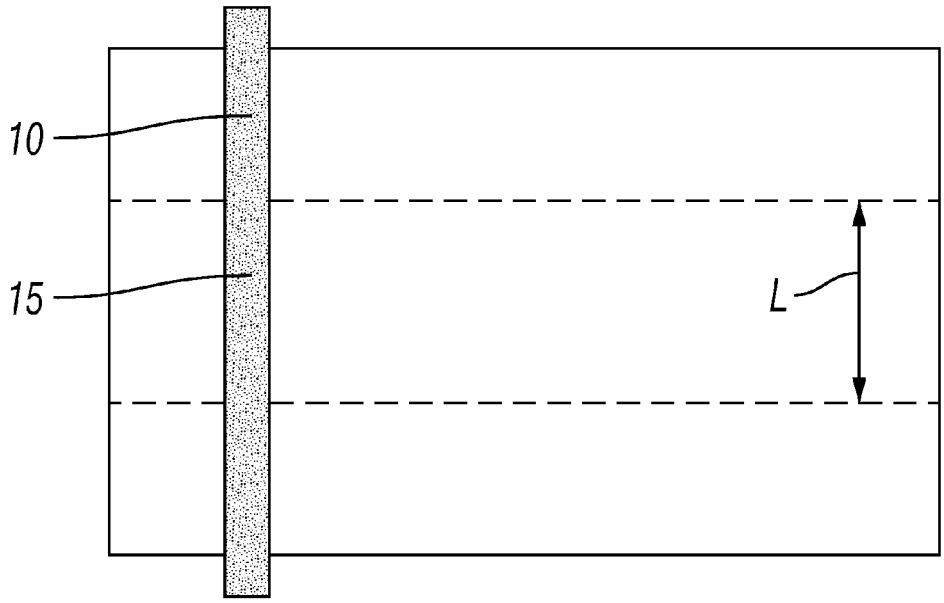
FIGS. 1A and 1B show a comparison of the drainage area between a regular perforated wellbore (FIG. 1A) and a slanted lateral drainhole drilled from a cased wellbore (FIG. 1B)

The invention is directed to a method suitable for recovering hydrocarbons from layered reservoirs that may be bypassed due to cross flow, water breakthrough or water coning during production using normal methods of well construction and completion. The method allows production to be maintained and delays the water or gas breakthrough and therefore allows the well to have a longer life span and obtain greater total production from the reservoir that would otherwise not be recovered.

The production of oil or gas from an underground formation is linearly dependant on the mobility of the fluid in the formation. For a given fluid, the most permeable flow units (discrete layers or sections of the reservoir) will be depleted much faster than less permeable flow units. This creates greater differences in pressure between the different layers of the multilayer reservoir. By distributing lateral boreholes or drainholes that extend out into the formation along that length of the main borehole such that each zone of the reservoir has the same flow rate, the pressure profile along the multiflow unit reservoir can be flattened and this can be effective to delay the production of water, such as may occur due to water coning.

The concept of this invention is based around a main borehole that is drilled into the formation so as to traverse the various reservoir layers.

To carry out of the method of the invention the theoretical production flow rate for each layer through which the main borehole passes is determined. The flow rate of any layer can be determined by any one of a number of methods known in the art.

The layer with the greatest flow rate is the reference to which other layers are related. Given the inherent properties of the formation in this layer, and the dimensions and completion of the main borehole, the reference flow rate can be determined.

Once the inherent flow rate of the remaining layers is known, the increase in drainage surface area that is needed to increase the overall flow rate of each layer to bring it to the level of the reference layer is determined such that all the layers of the reservoir would have substantially the same total flow rate. The surface area increase that the reservoir layer needs to allow it to have the same flow rate as other layers can be easily determined. Once the increase in drainage surface area needed for a particular layer is known lateral drainholes can be drilled into the layer from the main borehole to increase the drainage surface area in that layer. The drainholes can be drilled using any suitable drilling apparatus for drilling drainholes from a main borehole.

To determine the increase in surface area that is needed to flatten out the pressure profile to get the same flow rate between layers of a reservoir, reservoir simulations can be used. By looping the reservoir simulations calculations for different drainholes arrangements, in terms of length, diameter, angle and/or density (drainhole capacity per unit volume), the model providing the most similar productivity for the flow units or layers which corresponds to the optimized area increase can be systematically selected to find the best drainhole combination in terms of production, pressure profile flattening and water breakthrough delay. Reservoir simulations based on regular full implicit (black oil) equations, such as those in ECLIPSE reservoir engineering software available from Schlumberger, can be used (see ECLIPSE Technical Description 2006.2). The contribution of the drainholes to each layer can be modelled using standard well simulation conventions, such as by using the well Productivity Index or the associated skin factor (see for example, ECLIPSE Technical Description 2006.2 p 1061-1083). Alternatively these parameters can be determined by modelling the arrangements as described in SPE77363 (Furui K et al, A New Skin Factor Model for Perforated Horizontal Wells) and in SPE18247 (Karakas et al, Semianalytical Productivity Models for Perforated Completions), which aim to describe the equations for modelling standard perforations efficiencies, and then also take into account the length of the drainholes. An example of such software that is based on a combination of these models is SPAN (Schlumberger Perforation Analysis Program, further details of which can be found in Cased Hole Log Interpretation Principles/Applications published by Schlumberger in 1998). SPE18247 and SPE77363 provide further details of the analytical models on which SPAN is based.

The drainage surface area can be increased a number of different ways to achieve the same flow rate between the layers. This includes varying the drainhole density, the length of drainholes, the deviation of the drainholes and/or the radius of the drainholes between each of the layers in the formation depending on the layer mobility. This will result in different layers of the multilayer reservoir having different size and arrangement of drainholes depending on the initial flow rate of the layer and the flow rate of the reference layer.

Figure 1B:
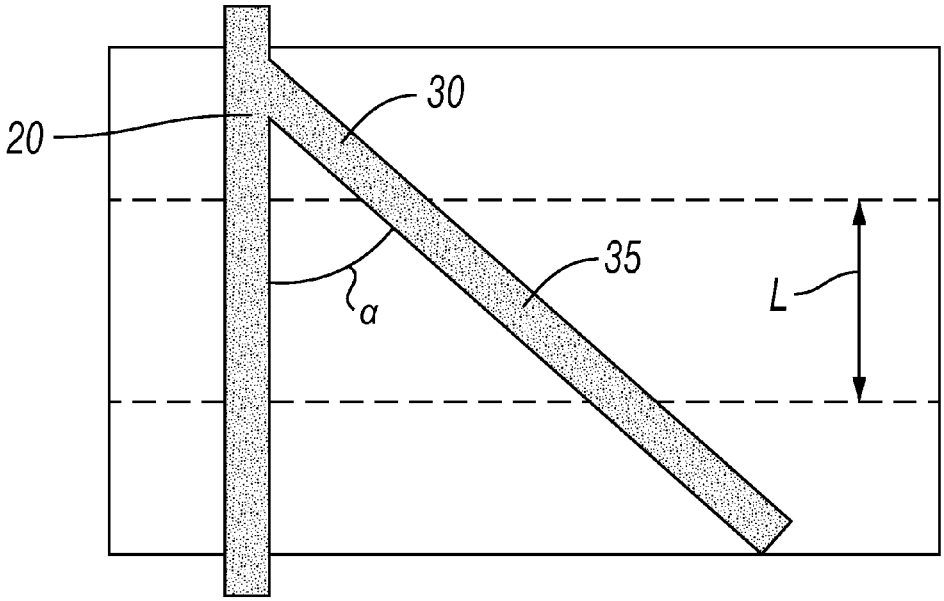

FIGS. 1A and 1B show a comparison between a standard perforated section 15 of a cased borehole 10 (FIG. 1A) and a cased borehole 20 having a deviated lateral borehole 30 drilled from the main cased borehole 20 (FIG. 1B). In layered or very anisotropic reservoirs, deviated drainholes 30 can be used radiating out from the main borehole 20 to increase the drainage surface area 35 of low mobility layers. Crossing the layering of a multilayer reservoir will increase the drainage surface area 35, as shown in FIG. 1B, compared to standard perforated sections 15 of the vertical sections of the main borehole 10 as shown in FIG. 1A.

Figure 2:
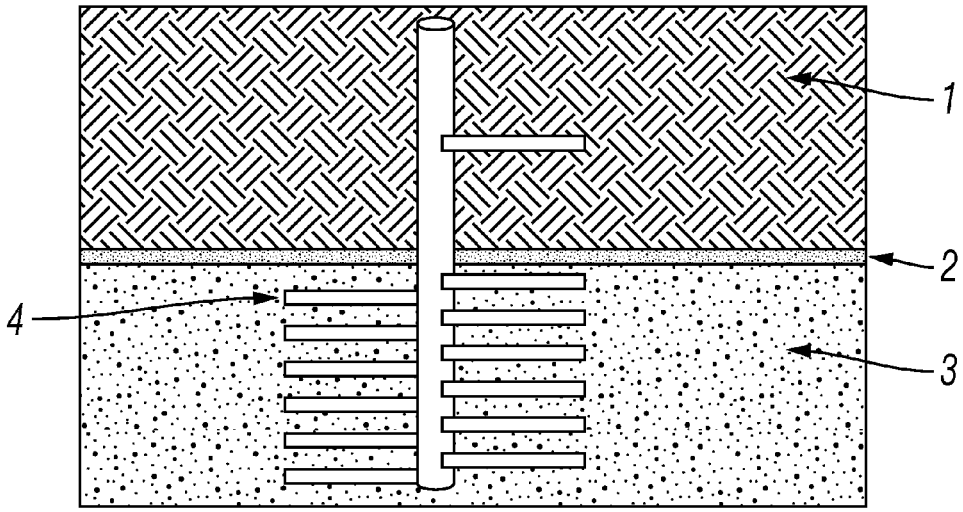
FIG. 2 shows locations of lateral drainholes on a regular vertical cased hole in a multilayer reservoir.

As shown in FIG. 2 the reservoir comprises a high permeability layer 1 (100 mD) and a low permeability layer 3 (100 mD) separated by an impermeable layer 2. By applying the method according to the invention, the increase in production surface of the low permeability layer 3 necessary to obtain the same production as the high permeability layer 1 is calculated. To achieve this increase in surface, a higher density of drainholes 4 in the layer is provided, compared to the high permeability layer 1. This will result in a different distribution of drainholes between the layers and results in the two layers having substantially the same flow rate.

Figure 3:
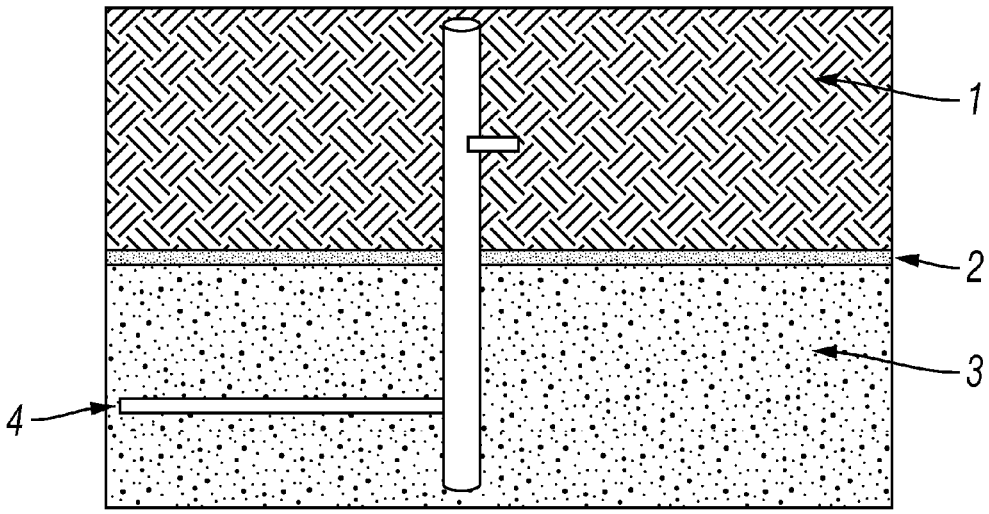
FIG. 3 shows the use of different length drainholes.

As shown in FIG. 3 the drainage area of a layer in the reservoir can also be increased by drilling longer drainholes 4 in the lower permeability layer 3 compared to the length of corresponding drainholes in the high permeability layer 3, to enable each layer to have the same flow rate. The drainage surface area can also be increased by increasing the diameter of the drainholes. Obviously, combinations of these techniques can be used to provide the increase in surface.

Having the same flow rate from each flow unit reduces the pressure difference that can occur between the layers. The flattening out of the pressure profile along the multi flow unit reservoir reduced the risk of water being produced at early times, by delaying water breakthrough.

While the invention has been described with reference to a reservoir having two layers with different flow rates, the method can be used to enhance hydrocarbon production in reservoirs having more than two layers with different flow rates. The method of the invention can also be used for both injection and production wells.

When there are three or more layers in the reservoir, the mobility of the fluid in all the reservoir layers is determined and used to determine the flow rates of each of the layers. The flow rates of each is compared and the reservoirs layers having the lowest flow rates will have their drainage surface area increased such that it will result in all the layers having substantially the same flow rate. This may require that drainage surface area of each of the separate reservoirs layers is increased by different amounts, depending on the initial flow rates of each layers.

Example

A multilayer reservoir wellbore is modelled in a Cartesian grid using ECLIPSE (see above). The reservoir model is made of two layers, layer 1 a high mobility layer having a permeability of 100 mD and layer 2 a low mobility layer having a permeability of 10 mD. The layers are separated by a shaly impermeable barrier.

Figure 4:
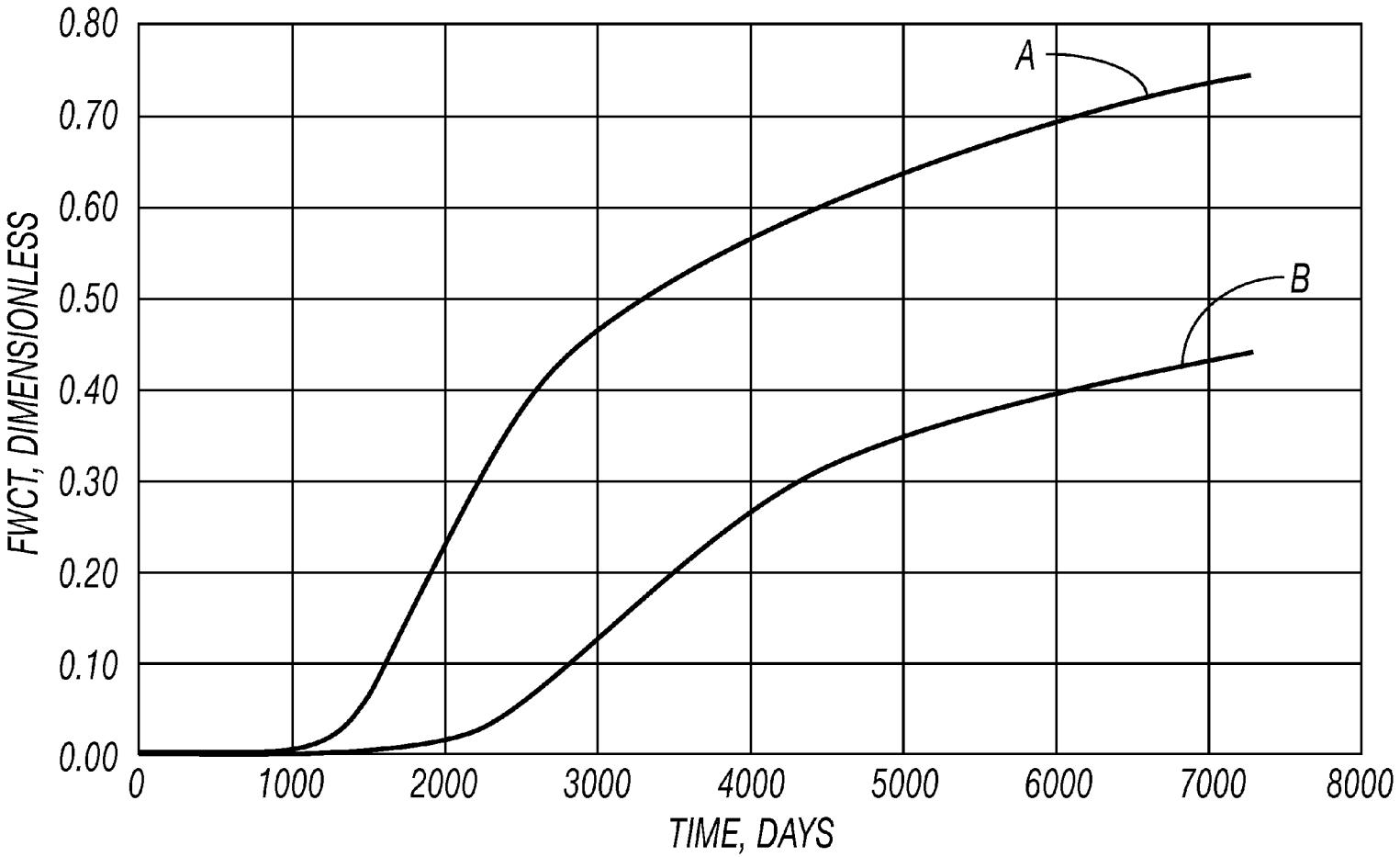
FIG. 4 shows well water cut comparison between a perforated cased hole (A) and lateral drainholes (B) when distributed as shown in FIG. 2.

The field pressure drop and water cut for a standard perforated vertical well and a cased hole with lateral drainholes are compared using the simulation model. The results obtained for the perforated cased hole and the well with lateral drainholes are shown in Table 1. FIG. 4 shows a comparison of the well water cut over time for a perforated cased hole and a well with lateral drainholes obtained using the simulation model.

TABLE 1

| | Perforated cased hole | Lateral drainholes |
|---|---|---|
| Daily production before water breakthrough | 1000 barrels | 850 barrels |
| Water breakthrough starting at | 1200 days | 2200 days |
| Water Cut limit (50%) | 3300 days | Not reached at 20 years production |
| Total production before reaching the Water Cut limit | 2,100,000 barrels | 2,700,000 barrels |

The wellbore with lateral drainholes produces for more than 10 extra years compared to a standard perforated cased hole, without the need to plug the high mobility layer. Water break through occurs 1000 days later in the well with lateral drainholes compared to the well with perforated casing.

As can be seen from the example increasing the drainage surface area in a low mobility reservoir layer, by providing lateral drainholes in the low mobility reservoir, delays the water breakthrough and increases the overall production of hydrocarbons before the water cut limit is reached. In this case, given the daily production, the critical water cut is assumed to be 50%.

This time at which the water break occurs can also be improved by providing slanted drainholes in the low mobility layer and/or by providing longer drainholes in the low mobility layer.

Although this invention has been described in terms of oil and gas wells, the method can also be applied to the water recovery industry for water reservoirs having multiple layers with different flow rates.

The invention claimed is:

1. A method, comprising:

drilling a main borehole into an underground reservoir comprising a plurality of layers of different fluid mobilities;

determining pressure differences between ones of the plurality of layers;

determining formation permeability and porosity in each of the plurality of layers;

determining the fluid mobility in each of the plurality of layers based on inclination of the main borehole and the determined formation permeability and porosity corresponding to each of the plurality of layers; and drilling a number of lateral boreholes extending from the main borehole in each of the plurality of layers, wherein lengths, diameters, deviations, axial positions, azimuthal arrangements, and the numbers of the lateral boreholes in each of the plurality of layers are collectively based on the determined fluid mobility in each of the plurality of layers, the determined pressure differences between ones of the plurality of layers, and the thickness of each of the plurality of layers, such that resulting fluid production rates in each of the plurality of layers are substantially similar.

2. The method of claim 1, wherein drilling a number of lateral boreholes extending from the main borehole in each of the plurality of layers comprises drilling longer lateral boreholes in layers having lower fluid mobilities relative to fluid mobilities and lengths of lateral boreholes in other layers.

3. The method of claim 1 wherein drilling a number of lateral boreholes extending from the main borehole in each of the plurality of layers comprises drilling more-deviated lateral boreholes in layers having lower fluid mobilities relative to fluid mobilities and deviations of lateral boreholes in other layers.

4. The method of claim 1 wherein drilling a number of lateral boreholes extending from the main borehole in each of the plurality of layers based on the determined fluid mobility in each of the plurality of layers comprises drilling larger-diameter lateral boreholes in layers having lower fluid mobilities relative to fluid mobilities and diameters of lateral boreholes in other layers.

5. The method of claim 1 further comprising determining parameters for each of the lateral boreholes prior to drilling the lateral boreholes.

6. The method of claim 5 wherein determining the parameters for each of the lateral boreholes comprises determining:

an axial position of each lateral borehole along the length of the main borehole;

an azimuthal orientation of each lateral borehole relative to the main borehole; and a track of each lateral borehole away from the main borehole.

7. The method of claim 5 wherein determining the parameters for each of the lateral boreholes is further based on parameters relating to drilling equipment available to drill the lateral boreholes.

* * * * *